United States Patent [19]

Woodruff

[11] Patent Number: 4,472,925

[45] Date of Patent: Sep. 25, 1984

[54] ANIMAL TRAINING HALTER

[76] Inventor: Dale Woodruff, 29670 Pamoosa La., Valley Center, Calif. 92082

[21] Appl. No.: 444,843

[22] Filed: Nov. 26, 1982

[51] Int. Cl.[3] ..... B68B 1/02

[52] U.S. Cl. ..... 54/24

[58] Field of Search ..... 54/6 R, 6 A, 15, 24, 54/85

[56] References Cited

U.S. PATENT DOCUMENTS

| | | | |
|---|---|---|---|
| 1,254,412 | 1/1918 | Kub | 54/24 |
| 1,734,891 | 11/1929 | Beckwith | 54/24 |
| 3,407,568 | 10/1968 | Henry | 54/24 |
| 3,418,787 | 12/1968 | Smith | 54/24 |
| 3,949,538 | 4/1976 | Woodruff | 54/24 |
| 4,180,963 | 1/1980 | Anderson | 54/24 |

*Primary Examiner*—Robert P. Swiatek

*Attorney, Agent, or Firm*—Wells, St. John & Roberts

[57] ABSTRACT

A halter for training animals having two loops which automatically expand and contract about the nose and head in response to force released or applied to the reins. The loop about the head is provided with a connection means so that the loop can be installed on the animal's head without pulling it over the sensitive ears. The halter is preferably constructed of a single strand of rope or other flexible material.

3 Claims, 4 Drawing Figures

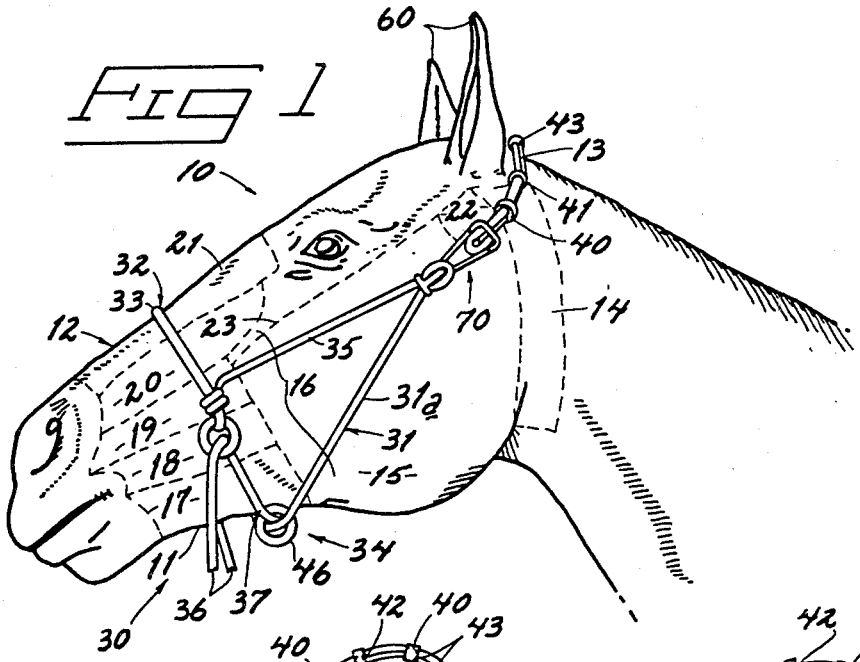
FIG 1
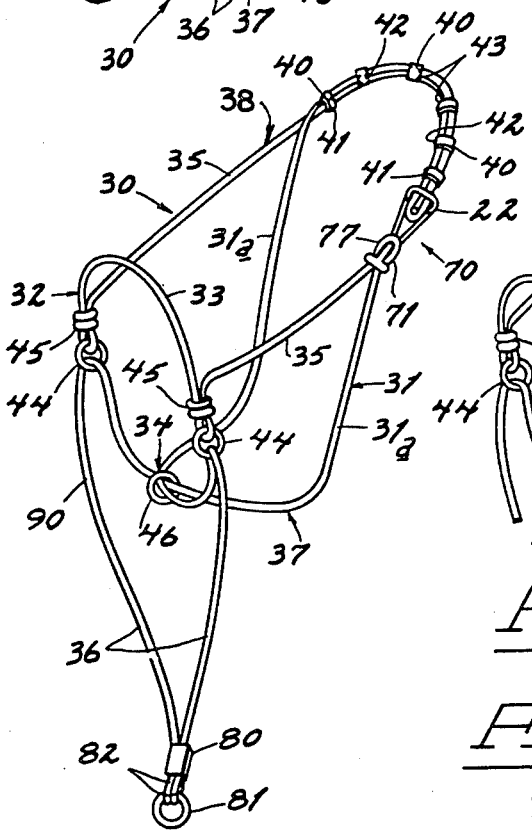
FIG 2
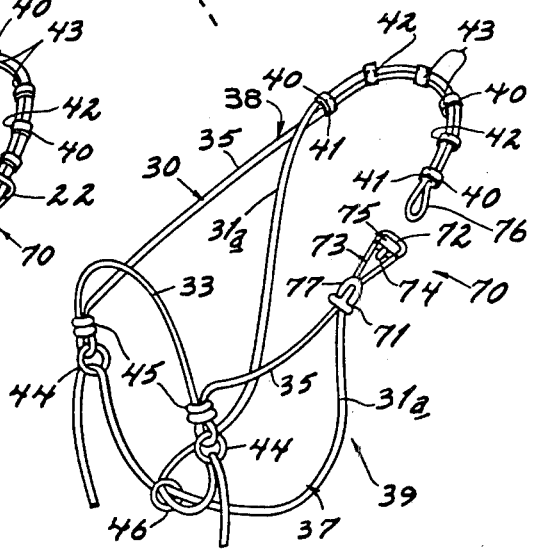
FIG 3
FIG 4
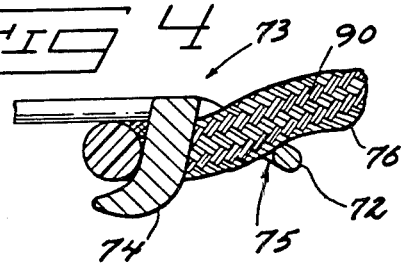

ANIMAL TRAINING HALTER

TECHNICAL FIELD

The technical field of this invention is animal training halters, especially halters used on horses.

BACKGROUND OF THE INVENTION

A wide variety of animal training halters have been used to help control and train animals. Of particular interest is a bitless halter shown in U.S. Pat. No. 3,949,538 to the inventor of the current invention. The halter shown in that patent incorporated one loop which encircled the nose and a second loop which encircled the head of the animal. The nose and head loops were interconnected so that when force was applied to the reins the nose and head loops contracted to apply pressure to the animal's head. Knots were positioned at strategic locations along the halter so that when the halter was tightened specific nerves were pressed upon by the halter and knots.

Although the invention shown in U.S. Pat. No. 3,949,538 proved to be particularly successful in training animals, it also proved to be difficult to place over a horse's head. The difficulty arose because the head loop of the harness had to be placed over the horse's ears which are particularly sensitive. Placing the head loop over the horse's ears also created problems because a person had to be relatively tall to hold the reins above the horse's ears or else the trainer had to get the horse to hold its head down so that the harness could be placed about the horse's head. Since many horses are not predisposed to being harnessed, getting them to hold their head down was often a problem.

It is economically advantageous to produce halters using a single strand of flexible cord which can be arranged in the desired configuration. To construct a halter which provided easy installation about the horse's ears and the desired automatic contraction and expansion with the desired single strand construction posed a significant challenge.

This invention is directed to solving the above problems and other problems which are discussed below or which are implicit in the nature and function of the training halter described herein.

BRIEF DESCRIPTION OF THE DRAWINGS

A preferred embodiment of the invention is illustrated in the accompanying drawings in which:

FIG. 1 is a perspective view showing the animal training halter of this invention placed on the head of a horse;

FIG. 2 is a perspective view showing the halter with the head or first loop connector securely fastened;

FIG. 3 is a perspective view of the halter shown in FIG. 2 with the head loop connector disconnected; and FIG. 4 is a cross-sectional detail view of the preferred form of the head loop connector.

DESCRIPTION OF A PREFERRED EMBODIMENT

In compliance with the constitutional purpose of the Patent Laws "to promote the progress of science and useful arts" (Article 1, Section 8), applicant submits the following disclosure of the invention.

The present invention may be utilized with any animal but it is primarily used in the training of horses. The present halter is intended to fit about a horse's head and nose as illustrated in FIG. 1 of the drawings. The head of the horse is designated generally in the drawing by the reference character 10. Head 10 as used herein is defined as that section of the horse including poll region 13 adjacent to the ears, parotid regions 14 ventral to the ears, the masseteric regions 15, and the posterior end of chin groove 11 adjacent masseteric regions 15.

The nose is generally indicated by 12 and for the purposes of this disclosure is intended to include a cheek region 16, a lateral nose region 20, and a hose bridge portion 21. The cheek region 16 may be broken down into three subregions comprising a mandibular subregion 17, molar subregion 18, and maxillary subregion 19. In addition, for purposes of explanation, a cheek crest is generally located at 23 extending along the head from the ears to the cheek regions 16.

The halter of the present invention is indicated generally by the reference character 30 in FIGS. 1 and 2. Halter 30 is constructed in a contractible and expandable figure eight configuration with a first loop 31 that encircles head 10, and a second loop 32 that encircles nose 12. First loop 31 and second loop 32 are integrally interconnected with one another at a crisscross intersection 34 located adjacent chin groove 11 when the halter is fitted to an animal's head as illustrated in FIG. 1.

Second loop 32 which encircles nose 12, extends from the crisscross 34 transversely across the ventral surface of mandibular subregion 17 and then dorsally across the molar subregion 18, maxillary subregions 19, lateral nose region 20 and finally transversely across the bridge of the nose 21.

Second or nose loop 32 is comprised of a nose band 33 that extends transversely over the nose bridge 21 to opposite sides of nose 12. The remainder of second loop 32 is comprised of the halter elements connected to the ends of nose band 33 and leading to crisscross intersection 34. Cheek members 35 are also provided and they extend between loop 31 and the ends of nose band 33 substantially along cheek crest 23. Reins 36 depend loosely from ring members 44 provided on either end of the nose band 33.

First or head loop 31 extends backwardly from the crisscross intersection 34 between first loop 31 and second loop 32. Diagonal sections **31*a* extend posteriorly and dorsally from crisscross 34 along opposite sides of the head cross the masseteric and parotid regions 15 and 14. The first loop 31 then extends around poll region 13 at the back of the head. This places first loop 31 behind ears 60**.

A connection means 70 is provided in first loop 31 to facilitate placement of the first loop about head 10 and ears 60. Connection means 70 releasably connects first part 38 and second part 39 of first loop 31. This arrangement allows the first part 38 to be easily positioned around the head 10 without forcing the first loop 31 over the horse's sensitive ears 60. After the first part 38 is positioned around the poll region 13 then it can be secured to second part 39 using connection means 70.

Connection means 70 can be of many different types of connectors commercially available at this time or in the future. One preferred connection means 70 incorporates an eye 71 through which a loop of rope 77 is extended and passed over the outer end 72. The connector body 73 is connected to eye 71 and has a hook 74 which extends across the open connector body 73 to define a second eye 75. Loop 76 formed at the end of first part 38 extends through eye 75 and over hook 74 to secure the first and second parts 38 and 39 of first loop 31 together about head 10.

Halter 30 may also be described as being comprised of two basic elements; nose band 33, and a control means 37. Control means 37 includes the remainder of halter 30 extending from nose band 33 to partially encircle the nose and then extending to completely encircle head 10. More particularly, control means 37 extends from opposite ends of nose band 33 adjacent the molar subregions 18, ventrally to chin groove 11 to cross over on itself at crisscross intersection 34. The control means then extends to opposite sides of head 10 and then dorsally and posteriorly across masseteric regions 15, parotid regions 14, and finally across poll 13. As illustrated, the control means is integral with rein members 36 and is slidably engaged with opposed ends of nose band 33 through ring members 44.

A pulling force on rein members 36 results in simultaneous circumferential contraction of nose loop 32 and head loop 31. Crisscross intersection 34 and the location of rings 44 along the opposite sides of nose 12 facilitate this simultaneous contraction. Further, this arrangement enables simultaneous and free circumferential expansion of the halter as tension is released from the reins 36.

It is important to note that the halter is contracted circumferentially about the nose and head since the rope comprising the loops is made shorter as reins are pulled through rings 44. The location of rings 44 facilitates both vertical and horizontal contraction of second loop 32 about nose 12. With the present arrangement, crisscross 34 is pulled upwardly toward rings 44 as tension is applied to reins 36. Nose band 33 is pulled simultaneously ventrally and therefore second loop 32 contracts circumferentially about the nose 12 in an efficient and effective manner.

The provision and location of rings 44 and crisscross intersection 34 also assist in circumferential contraction of the first loop about head 10. Crisscross intersection 34 is so located that pulling force through the rein 36 on one side of the head 10 is transferred to the opposite side of the head through the crisscross intersection 34. A simultaneous pulling force on both reins 36 serves to circumferentially contract the loops horizontally as well as vertically about the head 10 to apply relatively uniform inward pressure against nerves of the head and nose to control the behavior of the animal in a direct action-response mode.

In addition to the advantages provided by applying a rather uniform inward pressure about the head and nose by the automatically contracting and expanding loops, further important features are provided in the form of protuberances 41, 42, and 43 and knots 45. Protuberances 41, 42, and 43 are preferably part of metal clasps 40 which encircle and clamp together the strand of the flexible rope or cord in a fixed relationship to form loop 76. Protuberances 41, 42, 43 are strategically located to press upon sensitive nerves. The first pair of protuberances 41 are positioned to fit on either side of poll 13 slightly ventral to the ears within parotid region 14. This location is in close proximity to the facial nerves and, when the halter is contracted by applying a pulling force on reins 36, protuberances 41 are forced inwardly against the facial nerves causing additional discomfort to the horse to control its behavior.

The second and third pairs of protuberances 42, 43 are also positioned to fit along poll region 13. Upon contraction of first loop 31, protuberances 42, 43 press against the great auncular and second cervical nerves. Second and third pairs of protuberances 42, 43 aid and supplement the effects provided by the first protuberances 41.

In addition to first, second and third pairs of protuberances 41, 42, and 43 an additional pair of protuberances or knots 45 are provided at the ends of nose band 33. Knots 45 are located within the maxillary subregions 19 and are strategically positioned adjacent to and exterior of the infraorbital nerve and dorsal buccal branches of the facial nerves. Knots 45 are operative upon circumferential contraction of second loop 32 to apply additional pressure inwardly against the adjacent nerves to cause corresponding discomfort to the horse.

It is to be understood that the protuberances and knots can alternatively be provided in the form of buttons or other similar devices to direct a concentrated pressure at the selected areas of the animal's head in order to apply pressure to various selected nerves or branches thereof. Halter 30 may be constructed of rope, cable or other flexible material. Halter 30 is preferably constructed of ordinary braided rope that is so constructed so as to not chaff the animal's skin. Other possible construction materials include braided rawhide and/or a plastic coated metal cable.

Halter 30 is preferably constructed from a single strand 90 of flexible material. Strand 90 is threaded through the halter fittings 44, 46, 40, and 70. Knots 45 are tied to secure rings 44 in the proper position as well as providing protuberances which act upon nerves. The ends of the single strand of rope or other flexible material are preferably positioned through clamp 80 about ring 81 and back through clasp 80. Clasp 80 is pressed against the ends of the strand to secure the ends together and to secure ring 81 within loops 82.

The single strand construction reduces production costs and aids in the coaction of first and second loops 31, 32. As can be seen from FIGS. 2 and 3, the single strand 90 is arranged in a complex path to achieve the desired single strand construction. Strand 90 is formed into loops 76 and 77 which are integral parts of the connection means 70. This integration reduces the complexity of connection means 70. The portion of the strand returning from loops 76 and 77 toward knots 45 creates cheek sections 35 which help to stabilize the halter upon the head 10.

The halter is fitted to the animal's head by first sliding nose or second loop 32 about the animal's nose. The head or first loop 31 is placed about the animal's head by positioning its first part **31*a* around the head at poll region 13 behind ears 60. This allows the halter to be fitted without pulling the halter over the sensitive ears 60 which normally would cause the animal to raise its neck further complicating the installation of the halter. The connection means 70 is then connected by placing loop 76 through eye 75, hooking it over hook 74. This secures first part 38 to second part 39 to form the head loop 31 about the head 10**.

The operation of the halter will now be considered. When reins 36 are held slack, the halter is automatically positioned by the configuration of the animal's head to assume an expanded position. In this position, the halter creates no objectionable or disturbing pressures against any portion of the animal's head or nose. However, when desired, the reins 36 may be pulled relative to the animal's head to circumferentially contract the halter about the head and nose to contract loops 31 and 32 and protuberances 41, 42, 43, 45 consequently apply pressure to the respective nerves and nerve branches in the areas described. This pressure creates substantial discomfort for the animal and such discomfort may be utilized to discourage improper movements such as rearing, kicking, or other undesirable characteristics to be trained away from. The reins 36 may be hand held to be operated selectively by a trainer, or may be tied to a hitching post or other convenient anchor. When so anchored, the halter is utilized to automatically respond to undesired movement by contracting when the animal moves away from the anchor. Horses may be automatically trained not to rear against the halter or back away from the anchor since such movements will result in contraction of the halter and accompanying discomfort to the horse thereby enabling the horse to quickly learn which movements are undesirable.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An animal training halter for contraction and expansion about the head and nose of an animal in response to forces applied to and removed from the halter, comprising:

a single continuous strand of flexible material having two ends; the two ends of the single strand being connected to ring means 81 for applying force to the halter;

the continuous strand running from the two ends thereof slidably through two rings 44 for being positioned at opposite sides of an animal's nose;

the continuous strand continuing from the two rings 44 through a slidable crisscross intersection and extending therefrom to form a first part having a first part loop 76 and a second part having a second part loop 77, the first part being for extension along one side of the animal's head; the second part being for extension along the opposite side of the animal's head;

a connector for detachably connecting the first part loop 76 and the second part loop 77 together to allow said first and second parts to detachably extend about the head of the animal behind the animal's ears;

the continuous strand continuing from the first part loop 76 and the second part loop 77 back to rings 44 and forming knots 45 for fixing the positions of said two rings 44 upon the strand;

the continuous strand continuing between said knots 45 to form a nose band which extends over the animal's nose.

2. The animal training halter of claim 1 further defined by said first part being sufficiently long to be extendable along one side of the animal's head and across behind the animal's ears.

3. The animal training halter of claim 2 further comprising a plurality of clasps 40 connecting across said first part to securely form first part loop 76; the clasps 40 further having protuberances thereon for applying pressure to sensitive areas of the animal's head.

* * * * *